US011761283B2

(12) United States Patent
Xie et al.

(10) Patent No.: US 11,761,283 B2
(45) Date of Patent: Sep. 19, 2023

(54) CORE BARREL SEALING STRUCTURE CAPABLE OF INCREASING SEALING-SPECIFIC PRESSURE

(71) Applicants: SHENZHEN UNIVERSITY, Guangdong (CN); SICHUAN UNIVERSITY, Sichuan (CN)

(72) Inventors: Heping Xie, Sichuan (CN); Ling Chen, Sichuan (CN); Mingzhong Gao, Sichuan (CN); Jun Guo, Sichuan (CN); Zhilong Zhang, Sichuan (CN); Zetian Zhang, Sichuan (CN); Yiqiang Lu, Sichuan (CN); Cong Li, Sichuan (CN); Zhiqiang He, Sichuan (CN)

(73) Assignees: SHENZHEN UNIVERSITY, Guangdong (CN); SICHUAN UNIVERSITY, Sichuan (CN)

( * ) Notice: Subject to any disclaimer, the term of this patent is extended or adjusted under 35 U.S.C. 154(b) by 313 days.

(21) Appl. No.: 17/309,231

(22) PCT Filed: Nov. 12, 2018

(86) PCT No.: PCT/CN2018/114967
§ 371 (c)(1),
(2) Date: Mar. 11, 2022

(87) PCT Pub. No.: WO2020/093415
PCT Pub. Date: May 14, 2020

(65) Prior Publication Data

US 2022/0213750 A1 Jul. 7, 2022

(30) Foreign Application Priority Data

Nov. 8, 2018 (CN) ..... 201811328060.0

(51) Int. Cl.
*E21B 25/02* (2006.01)
*E21B 25/08* (2006.01)
*E21B 25/12* (2006.01)

(52) U.S. Cl.
CPC ..... *E21B 25/08* (2013.01); *E21B 25/12* (2013.01)

(58) Field of Classification Search
CPC ..... E21B 2200/05
See application file for complete search history.

(56) References Cited

U.S. PATENT DOCUMENTS 2,217,147 A * 10/1940 Vesely ..... E21B 27/00 166/167
3,370,784 A * 2/1968 Day ..... B63C 9/24 141/286

(Continued)

FOREIGN PATENT DOCUMENTS

CN 102134980 A 7/2011
CN 107313732 A 11/2017

(Continued)

*Primary Examiner* — Kipp C Wallace
(74) *Attorney, Agent, or Firm* — NKL Law; Allen Xue

(57) ABSTRACT

A core barrel sealing structure includes a core barrel, a drilling machine outer barrel, a chain mail-type flap valve and a trigger mechanism. The flap valve includes a valve seat and a chain mail-type valve flap. The trigger mechanism includes a trigger inner barrel and a trigger block. The trigger block is arranged in a through hole in a sidewall of the trigger inner barrel, and an inner wall of the drilling machine outer barrel is provided with a recessed opening adapted to the trigger block. When the core barrel is located in the valve seat, the valve flap is opened by 90° and is located between the trigger inner barrel and the drilling machine outer barrel. When the core barrel is lifted upwards, the valve flap returns to a top face of the valve seat to make sealing contact with a sealing face of a valve opening.

10 Claims, 10 Drawing Sheets

(56) References Cited

U.S. PATENT DOCUMENTS

| | | | | |
|---|---|---|---|---|
| 4,605,075 | A * | 8/1986 | Radford | E21B 25/04 175/246 |
| 4,607,710 | A * | 8/1986 | Radford | E21B 25/10 175/58 |
| 5,253,720 | A | 10/1993 | Radford et al. | |
| 6,079,497 | A * | 6/2000 | Johnston | E21B 34/101 166/324 |
| 6,695,078 | B2 * | 2/2004 | Kim | E21B 49/02 175/251 |
| 2009/0090518 | A1 * | 4/2009 | Coon | E21B 27/00 166/236 |
| 2012/0234607 | A1 * | 9/2012 | Kinsella | E21B 25/02 175/403 |
| 2015/0255179 | A1 | 9/2015 | Rosen et al. | |
| 2016/0290078 | A1 * | 10/2016 | Church | E21B 47/00 |
| 2018/0347301 | A1 * | 12/2018 | Hilliard | E21B 21/10 |

FOREIGN PATENT DOCUMENTS

| | | | |
|---|---|---|---|
| CN | 107514240 | A | 12/2017 |
| CN | 206860111 | U | 1/2018 |

* cited by examiner

CORE BARREL SEALING STRUCTURE CAPABLE OF INCREASING SEALING-SPECIFIC PRESSURE

TECHNICAL FIELD

The present invention relates to the technical field of coring equipment, and especially to a core barrel sealing structure capable of increasing the sealing-specific pressure.

BACKGROUND ART

At present, in the field of pressure keeping and coring, the upper end of the pressure keeping barrel is generally sealed by a piston, while the lower end of the pressure keeping barrel is usually sealed by a ball valve or a flap valve. The structure of the ball valve is relatively complex and the space occupied is large, which limits the diameter of the drilled core. The processing technology of the ball valve is demanding. When the pressure is high, the liquid in the pressure holding barrel will seep out from the gap between the ball valve and the core barrel, and thus a higher pressure can not be maintained. While, the existing flap valve can maintain a higher pressure, although the structure is simple, but its valve flap is a fixed shape, can not be deformed, and the success rate of matching is low. In addition, the sealing performance of flap valve is poor when the sealing-specific pressure is low.

CONTENT OF THE INVENTION

The present invention is intended to provide a core barrel sealing structure that can increase the sealing-specific pressure. A flap valve is used to perform lower end sealing, that has a deformable flap and a high success rate of matching. A trigger mechanism is added to increase the sealing-specific pressure and improve the sealing performance of the valve, when the flap valve is closed.

In order to realize the above objectives, the technical solutions adopted by the present invention are as follows:

A core barrel sealing structure that can increase sealing-specific pressure, that includes a core barrel, a drilling machine outer barrel, a chain mail-type flap valve, and a trigger mechanism. The chain mail-type flap valve includes a valve seat and a chain mail-type valve flap. The valve seat is coaxially installed on the inner wall of the drilling machine outer barrel. One end of the valve flap is movably connected with the outer sidewall of the upper end of the valve seat. The top of the valve seat has a valve opening sealing surface adapted to the valve flap; the valve flap includes an elastic sealing ring, elastic connecting strips, sealings, and a plurality of locking strips arranged in parallel; the elastic connecting strip connects all the locking strips in series, and the elastic sealing ring hoops all the locking strips together, to form an integral structure, and there is a sealing between two adjacent locking strips;

The trigger mechanism comprises a trigger inner barrel and a trigger block, and the side wall of the trigger inner barrel is provided with a through hole. The trigger block is arranged in the through hole. The outer sidewall of the bottom of the core barrel is provided with a protrusion that matches the trigger block. The inner wall of the drilling machine outer barrel is fitted with a recessed opening adapted to the trigger block. The trigger block is located above the valve flap, and the recessed opening is located above the trigger block.

When the core barrel is located in the valve seat, the trigger inner barrel is located between the core barrel and the drilling machine outer barrel. The lower end of the trigger inner barrel is matched with the valve seat stop, and the trigger block protrudes from the inner sidewall of the trigger inner barrel.

The valve flap is opened by 90° and is located between the trigger inner barrel and the drilling machine outer barrel. When the core barrel is lifted upwards to a certain height, the valve flap returns to a top face of the valve seat to make sealing contact with a sealing face of a valve opening, two adjacent locking strips are in sealing contact, and the bottom of the trigger inner barrel is pressed against the valve flap.

Further, the trigger mechanism also includes a trigger spring, that is sleeved outside the trigger inner barrel; the outer wall of the trigger inner barrel is provided with a shoulder, the lower end of the trigger spring is pressed against the shoulder, and the upper end of the trigger spring is pressed against the step surface of the drilling machine outer barrel; the trigger spring is located above the trigger block.

Wherein, the locking strip is provided with a groove adapted to the elastic sealing ring, and the elastic sealing ring is installed in the groove.

Further, when the valve flap is opened 90°, the locking strip is parallel to the axis of the valve seat.

Further, when the valve flap is in sealing contact with the valve seat, the valve flap has a circular flat structure.

Further, except for the two locking strips at the beginning and the end, one side of the other locking strips has a wedge-shaped through groove, and the opposite side has a convex part that fits with the wedge-shaped through groove;

One of the first and last locking strips is provided with a wedge-shaped through groove, while the other locking strip is provided with a convex part;

The convex part of one of the two adjacent locking strips is matched with the wedge-shaped through groove of the other, and the sealing element is arranged between the groove wall and the convex part of the wedge-shaped through groove.

Further, one of the wedge-shaped through grooves has the limit step surface 1 on the groove wall, while the convex portion of the corresponding locking strip has the limit step surface 2 that matches with the limit step surface 1;

When the valve flap is in sealing contact with the valve seat, the limit step surface 1 and the limit step surface 2 are located below the elastic sealing ring, the limit step surface 1 and the limit step surface 2 conflict, and the limit step surface 1 is located on the outside of limit step face 2.

Wherein, the sealing element is installed on the groove wall of the wedge-shaped through groove.

Further, the valve flap is movably connected to the valve seat through a spring sheet, and the spring sheet includes a rotating shaft and an elastic sheet. The outer sidewall of the top end of the valve seat has a rotating shaft accommodating groove that matches the rotating shaft, in which the rotating shaft is installed. The outer surface of the valve flap is provided with an elastic sheet accommodating groove for accommodating the elastic sheet, in which the elastic sheet is installed.

Wherein, a sealing ring is arranged between the outer wall of the valve seat and the inner wall of the drilling machine outer barrel.

Compared with the prior art, the present invention has the following beneficial effects:

The core barrel sealing structure according to the present invention achieves lower-end sealing by means of the chain mail-type flap valve. When the valve is open, the chain mail-type flap valve is deformed and hidden between the core barrel and the drilling machine outer barrel, saving space and eliminating the restriction on the diameter of the drilled core. When the core barrel is raised to a certain height, the chain mail-type valve flap automatically closes, and the valve flap has a strong deformability, thus can automatically adjust a sealing matching position and has a high success rate of matching, with a reliable sealing performance. Moreover, the valve flap has a reverse self-locking property under pressure when the pressure is maintained. The valve flap also is pressed by the trigger inner barrel that has fallen back, such that the sealing-specific pressure is great, and the sealing performance thereof is reliable.

In Figures: 1-core barrel, 2-drilling machine outer barrel, 4-spring sheet, 6-drilling bit, 7-core catcher, 8-piston, 11-convex part, 12-ring groove, 21-upper outer barrel, 22-lower outer barrel, 23-threaded connection sleeve, 24-recessed opening, 31-valve seat, 32-valve flap, 41-shaft, 42-elastic sheet, 51-trigger spring, 52-trigger inner barrel, 53-trigger block, 521-shoulder, 201-locking strip, 202-elastic connecting strip, 203-sealing element, 211-wedge-shaped through groove, 212-protruding part, 213-limit step surface 1, 214-limit step surface 2, 231-sealing strip, 232-metal seal, 233-graphite, 234-auxiliary seal, 311-valve port sealing surface, 321-elastic sheet accommodating groove, 322-elastic sealing ring.

EXAMPLES

Figure 1:
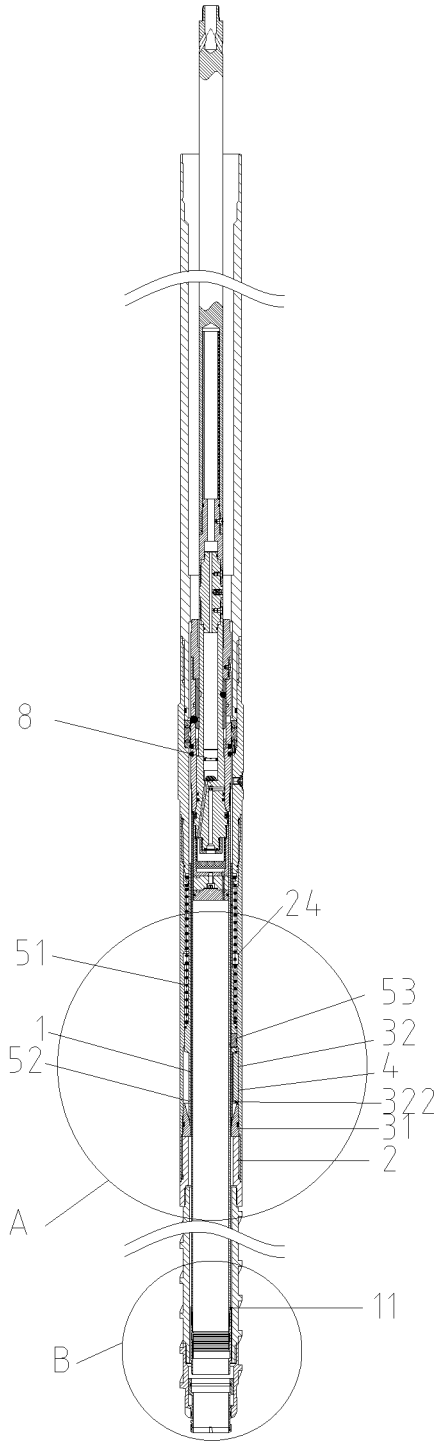
FIG. 1. The structural diagram of the present invention when the chain mail-type flap valve is opened.
Figure 2:
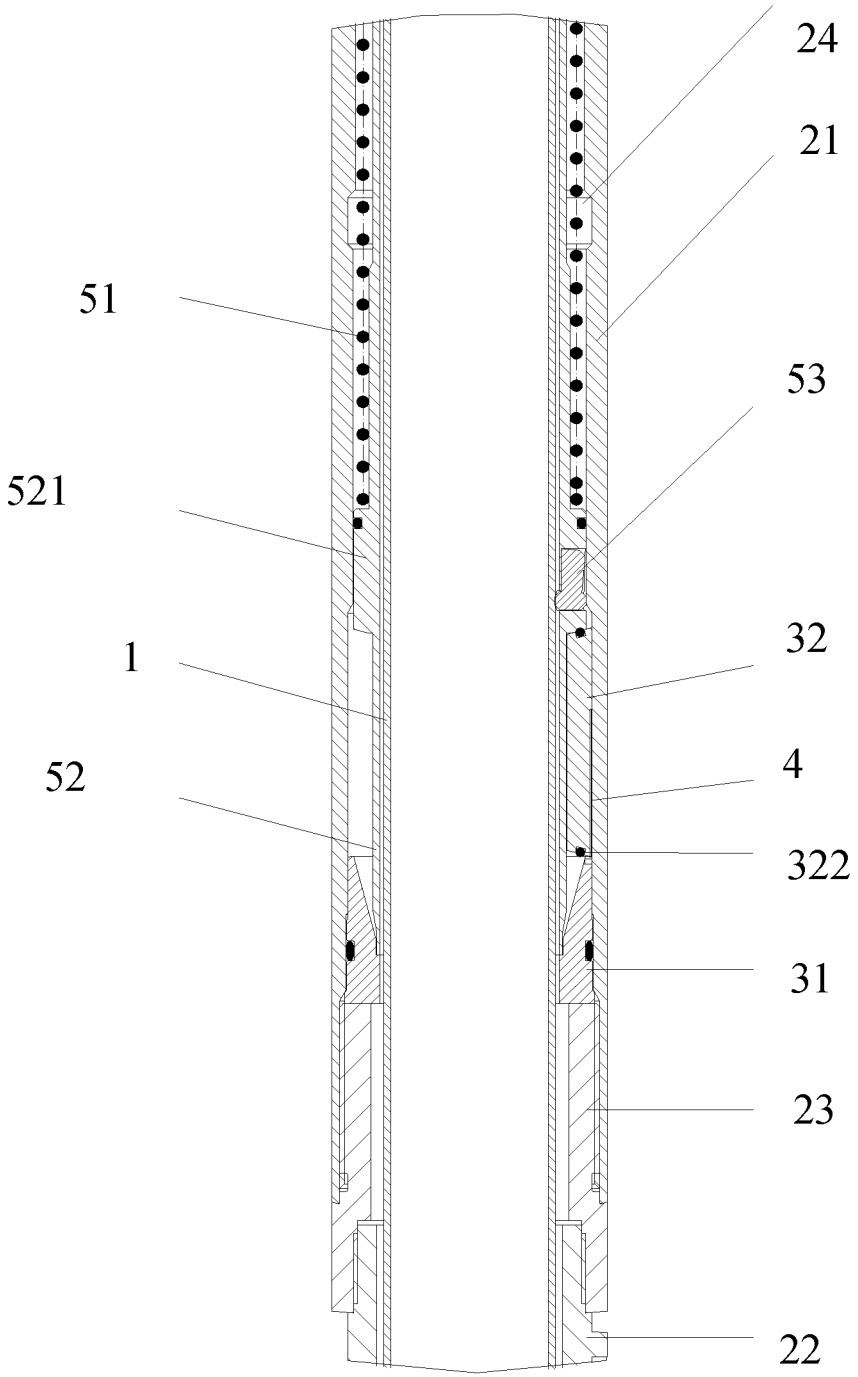
FIG. 2. Enlarged view of A in FIG. 1.
Figure 6:
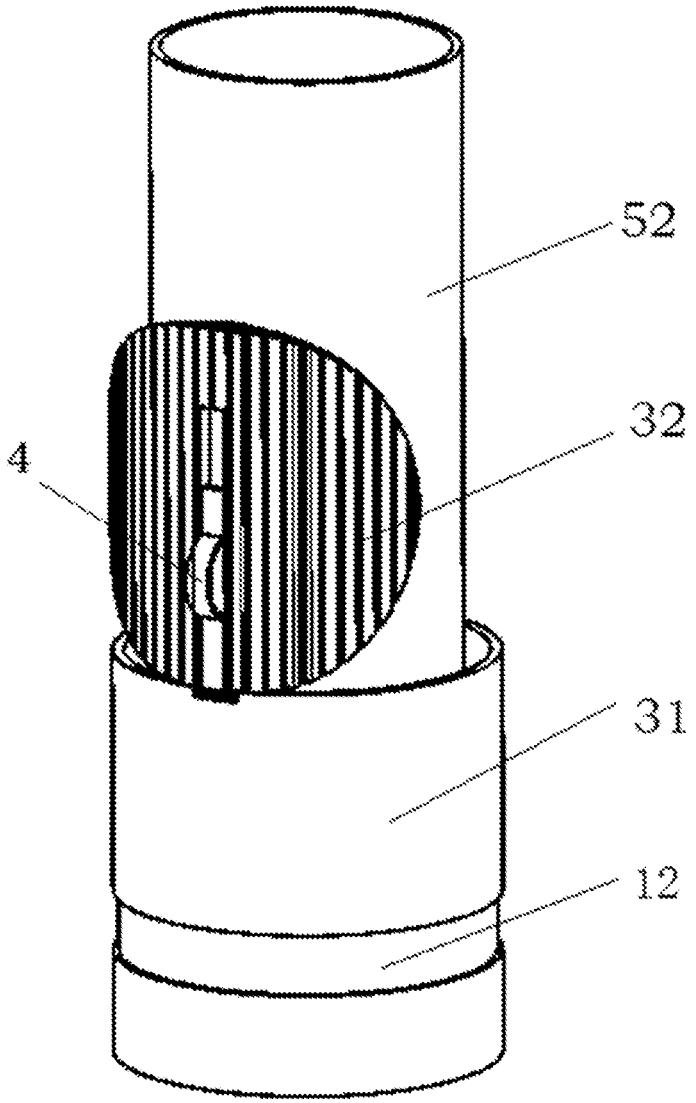
FIG. 6. Three-dimensional view of the chain mail-type flap valve with the core barrel in the valve seat.

In order to make the objectives, technical solutions, and advantages of the present invention clearer, the present invention will be further illustrated hereinafter by combing with the attached Figures. As shown in FIGS. 1, 2, and 6, the core barrel sealing structure disclosed in the present invention that can increase sealing-specific pressure includes a core barrel 1, a drilling machine outer barrel 2, a chain mail-type flap valve, and a trigger mechanism. The chain mail-type flap valve includes a valve seat 31 and a chain mail-type valve flap 32. The valve seat 31 is coaxially installed on the inner wall of the drilling machine outer barrel 2. One end of the valve flap 32 is movably connected with the outer sidewall of the upper end of the valve seat. The top of the valve seat 31 has a valve opening sealing surface 311 adapted to the valve flap 32.

The trigger mechanism comprises a trigger inner barrel 52 and a trigger block 53, and the side wall of the trigger inner barrel 52 is provided with a through hole. The trigger block 53 is arranged in the through hole. The outer sidewall of the bottom of the core barrel 1 is provided with a protrusion 11 that matches the trigger block 53. The inner wall of the drilling machine outer barrel 2 is fitted with a recessed opening 24 adapted to the trigger block 53. The trigger block 53 is located above the valve flap 32, and the recessed opening 24 is located above the trigger block 53.

As shown in FIGS. 1 and 2, When the core barrel 1 is located in the valve seat 31, the trigger inner barrel 52 is located between the core barrel 1 and the drilling machine outer barrel 2. The lower end of the trigger inner barrel 52 is matched with the valve seat 31 stop, and the trigger block 53 protrudes from the inner sidewall of the trigger inner barrel 52. The outer side of the trigger block 53 is in contact with the inner wall of the drilling machine outer barrel 2, while the inner side of the trigger block 53 is in contact with the outer wall of the core barrel 1. The valve flap 32 is opened by 90° and is located between the trigger inner barrel 52 and the drilling machine outer barrel 2.

Figure 4:
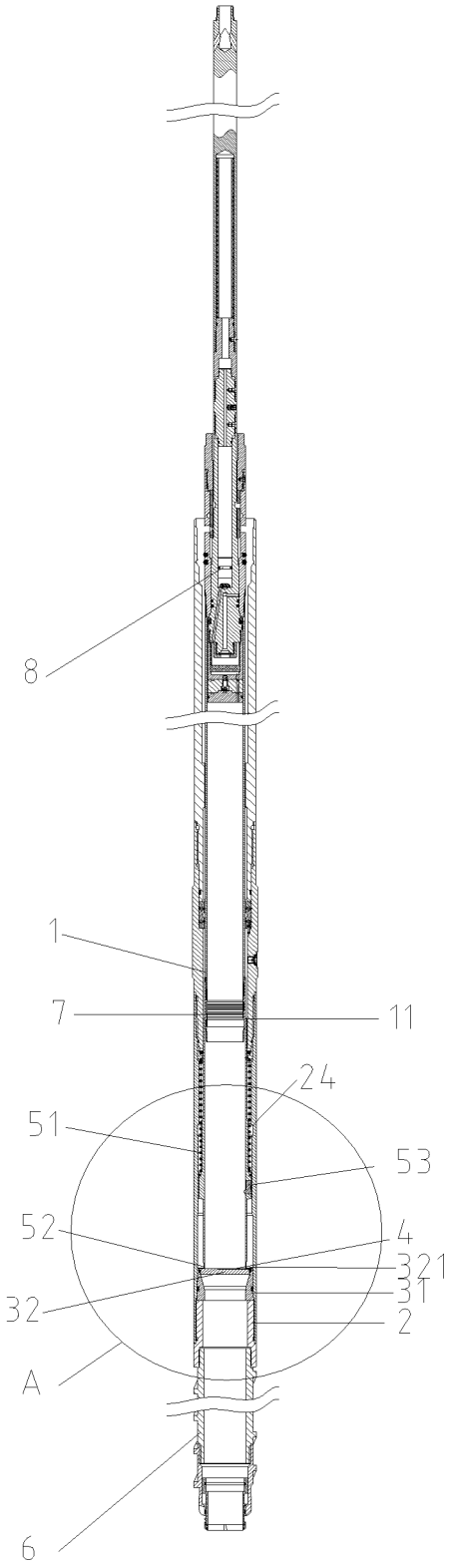
FIG. 4. The structural diagram of the present invention when the chain mail-type flap valve is closed.
Figure 5:
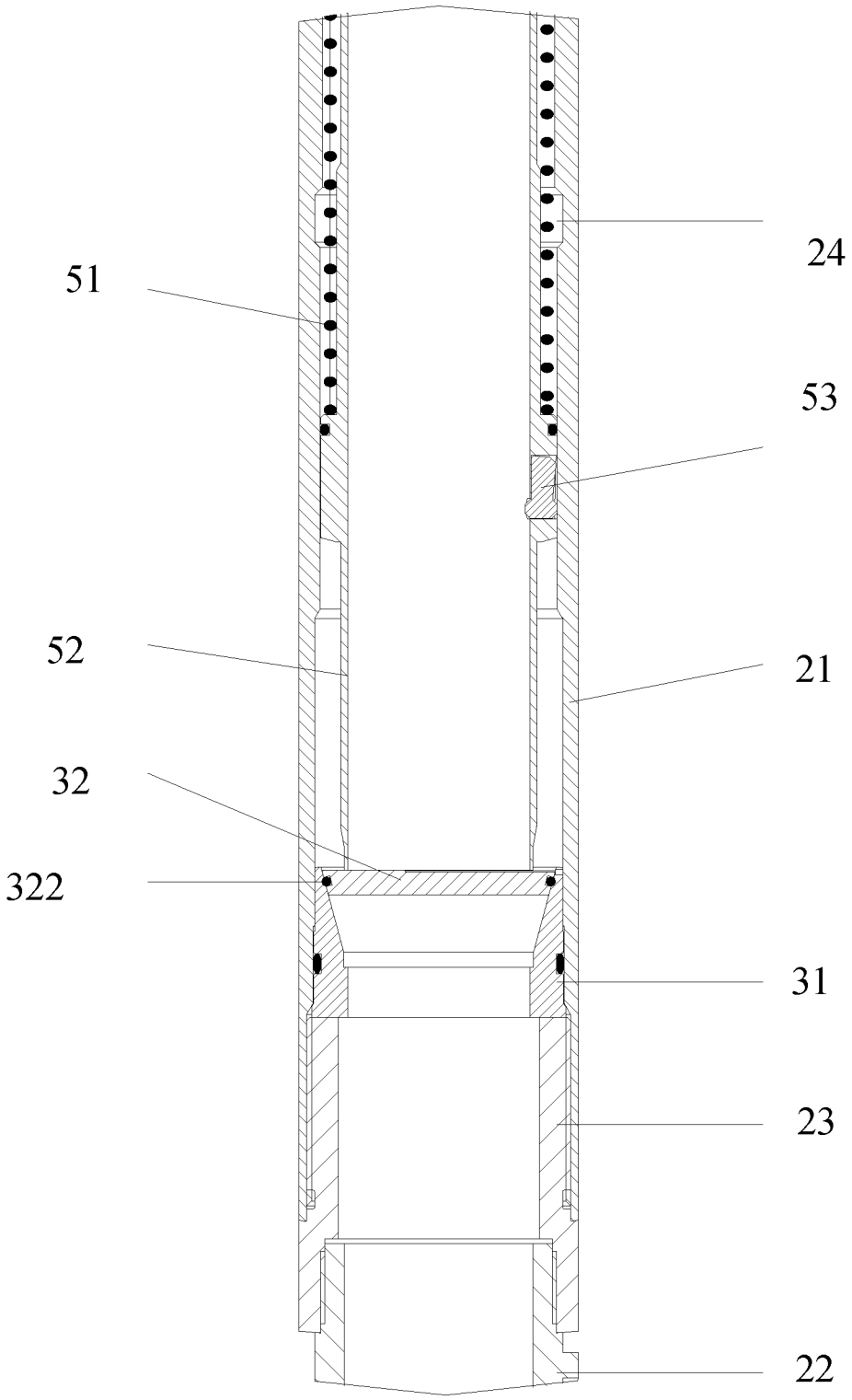
FIG. 5. Enlarged view of A in FIG. 4.

As shown in FIGS. 4 and 5, when the core barrel 1 is lifted upwards over the chain mail-type flap valve, the convex part 11 at the bottom of the core barrel 1 drives the trigger block 53 to rise, and then drives the trigger inner barrel 52 to rise. When the bottom of the trigger inner barrel 52 passes the valve flap 32, the valve flap 32 reverses and returns to the top surface of the valve seat 31 to make sealing contact with the valve opening sealing surface 311, and the chain mail-type flap valve is closed.

When the trigger block 53 reaches the recessed opening 24 of the drilling machine outer barrel 2 along with the core barrel 1, the trigger block 53 can be displaced radially and then separated from the role of the protruding portion 11 of the core barrel 1; when the bottom of the core barrel 1 passes the recessed opening 24, the trigger block 53 loses the force of the core tube 1 and triggers the inner barrel 52 to slide down under the action of gravity, and finally presses on the valve flap 32 to apply a sealing-specific pressure to the valve flap 32.

In another embodiment, the trigger mechanism further includes a trigger spring 51, and the trigger spring 51 is sleeved outside the trigger inner barrel 52. The outer wall of the trigger inner barrel 52 is provided with a shoulder 521, the lower end of the trigger spring 51 is pressed against the shoulder 521, and the upper end of the trigger spring 51 is pressed against the step surface of the drilling machine outer barrel 2; the trigger spring 51 is located above the trigger block 53. When the core barrel 1 is lifted upwards over the chain mail-type flap valve, the convex part 11 at the bottom of the core barrel 1 drives the trigger block 53 to rise, and then drives the trigger inner barrel 52 to compress trigger spring 51 and rise. When the bottom of the core barrel 1 passes the recessed opening 24, the trigger block 53 loses the force of the core tube 1, and the trigger inner barrel 52 drives the trigger block 53 to slide down under the action of the elastic force of the trigger spring 51 and its own gravity, and finally presses on the valve flap 32 to apply a sealing-specific pressure to the valve flap 32.

Wherein, as shown in FIG. 5, the drilling machine outer barrel 2 includes an upper outer barrel 21, a lower outer barrel 22, and a threaded connection sleeve 23. The lower end of the threaded connection sleeve 23 is provided with internal threads, while the upper end of the threaded connection sleeve 23 is provided with external threads. The upper end of the lower outer cylinder 22 is threadedly connected to the lower end of the threaded connection sleeve 23, and the lower end of the upper outer cylinder 21 is threadedly connected to the upper end of the threaded connection sleeve 23.

As shown in FIGS. 5 and 6, the outer wall of the valve seat 31 is provided with an annular groove 12 for installing a sealing ring, and the annular groove 12 is equipped with a sealing ring to realize the sealing cooperation between the valve seat 31 and the drilling machine outer barrel 2.

Figure 7:
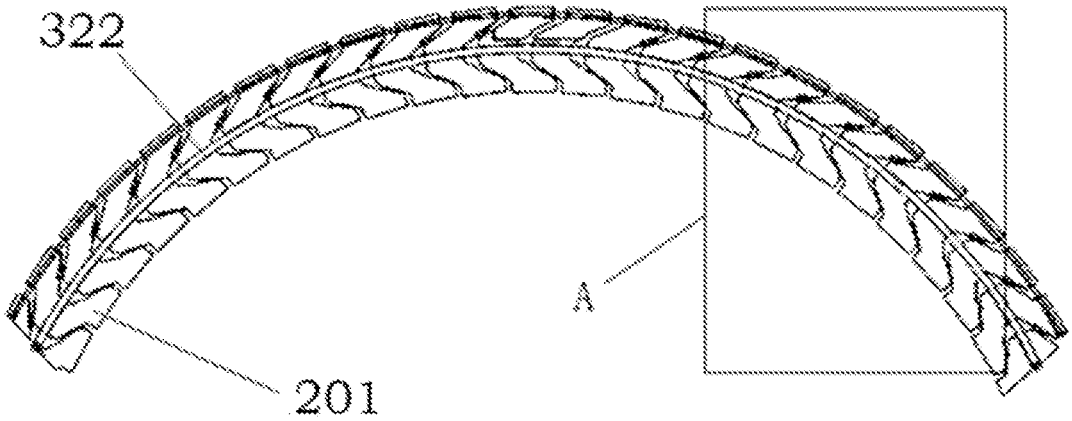
FIG. 7. The top view of the valve flap in FIG. 6.
Figure 8:
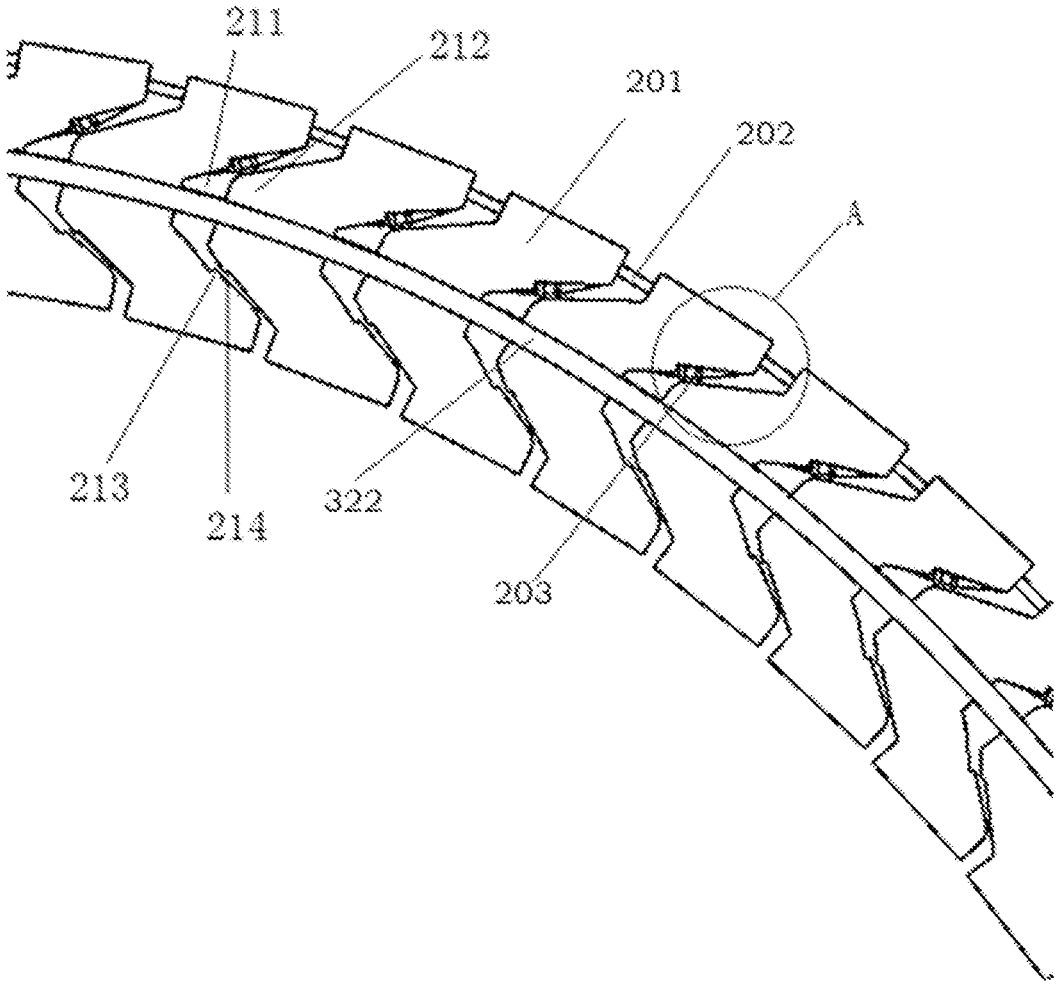
FIG. 8. A partial enlarged view of A in FIG. 7.

The structure of the chain mail-type flap valve in this example is shown in FIG. 6. As shown in FIGS. 7 and 8, the valve flap 32 includes an elastic sealing ring 322, an elastic connecting strip 202, a sealing element 203, and a plurality of parallel locking strips 201 in sequence. There are at least three locking strips 201, and the number and size of the locking strip 201 are determined according to the size of the sealing surface of the valve port. The elastic connecting strip 202 connects all the locking strips 201 in series, and the elastic sealing ring 322 hoops all the locking strips 201 together to form an integral structure. The locking strip 201 is provided with a groove adapted to the elastic sealing ring 322, in which the elastic sealing ring 322 is installed. A sealing element 203 is provided between two adjacent locking strips 201. Since the multiple locking strips 201 arranged in parallel are connected in series by the elastic connecting strip 202 and tightly clamped by the elastic sealing ring 322. When the valve flap 32 or the locking strip 201 receives an external force, the locking strip 201 and the elastic sealing ring 322 can be elastically deformed, and then two adjacent locking strips 201 can undergo relative displacement and rotation, so the valve flap 32 can be deformed when subjected to an external force.

As shown in FIGS. 2, 6, and 7, when the core barrel is located in the valve seat 31, the valve flap 32 is opened 90° due to the force of the trigger inner barrel 52 on the core barrel 1, and the double-sided force of the trigger inner barrel 52 and the drilling machine outer barrel 2 makes two adjacent locking strips 201 be opened. The valve flap 32 is deformed and finally hidden between the trigger inner barrel 52 and the drilling machine outer barrel 2, and the inner surface of the valve flap 32 is completely attached to the outer side wall of the trigger inner barrel 52, to save space and eliminate the restriction on the drilled core diameter. At this time, the locking strip 201 is parallel to the axis of the valve seat 31.

As shown in FIGS. 4 and 5, when the core barrel 1 is lifted up to a certain height, the valve flap 32 returns to the top surface of the valve seat 31 and is in sealing contact with the valve port sealing surface 311. Two adjacent locking strips 201 are also in sealing contact, thereby blocking the medium.

As shown in FIGS. 7 and 8, except for two locking strips 201 at the beginning and the end, one side of the other locking strips 201 has a wedge-shaped through groove 211, and the opposite side has a convex portion 212 that is adapted to the wedge-shaped through groove 211. One of the first and last locking strips 201 is provided with a wedge-shaped through groove 211, and the other locking strip 201 is provided with a convex portion 212; the convex portion 212 of one 201 of two adjacent locking strips 201 is trapped in the wedge-shaped through groove 211 of the other locking strip 201. The sealing element 203 is installed on the groove wall of the wedge-shaped through groove 211.

Figure 9:
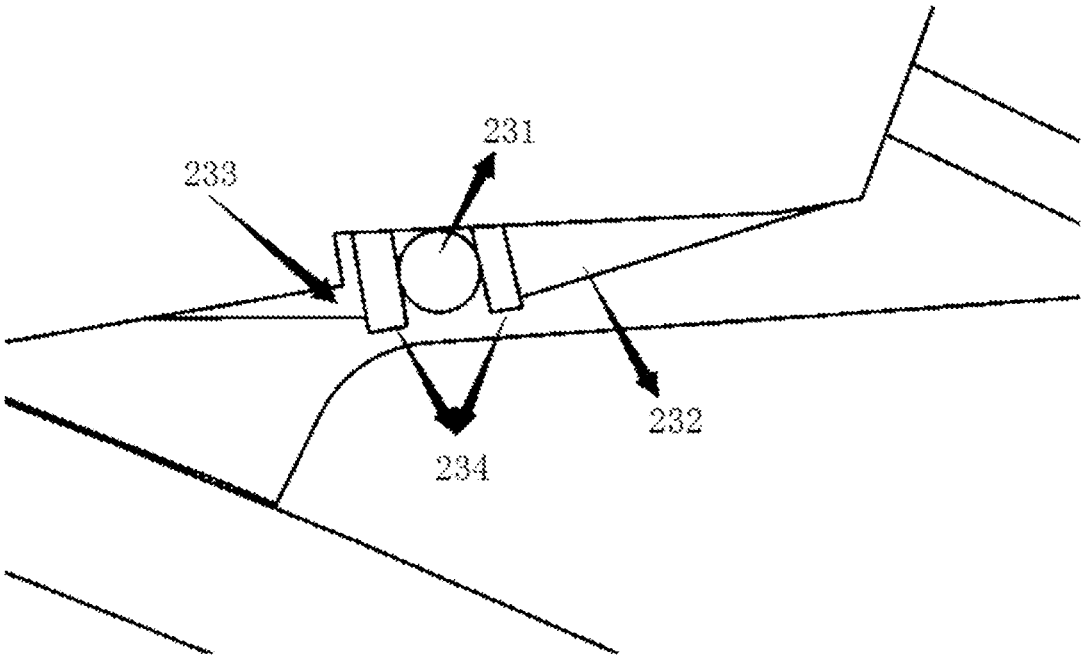
FIG. 9. A partial enlarged view of A in FIG. 8.

As shown in FIGS. 8 and 9, the sealing element 203 is installed on one of the groove walls of the wedge-shaped through groove 211, and the other groove wall of the wedge-shaped through groove 211 has the limit step surface 1 213, while the convex portion 212 of the corresponding locking strip 201 has the limit step surface 2 214 that matches with the limit step surface 1 213. When the valve flap 32 is in sealing contact with the valve seat 31, the limit step surface 1 213 and the limit step surface 2 214 are located below the elastic sealing ring 322, as well as the limit step surface 1 213 and the limit step surface 2 214 conflict, and the limit step surface 1 213 is located on the outside of limit step face 2 214, to prevent the withdrawing of protrusion 212 from the wedge-shaped through groove 211 when the valve flap 32 is under pressure, so that it can be reversely self-locked when the pressure is maintained.

The sealing element 203 includes a sealing strip 231 for providing a soft seal, a metal seal 2032 for providing a hard seal, and two auxiliary seals 234. The sealing strip 231 is installed between two auxiliary seals 234, which fix the position of the sealing strip 231 and protect the sealing strip 231. Preferably, the sealing element 203 also includes graphite 233. The sealing strip 231 is located between graphite 233 and the metal seal 2032, while graphite 233 is located inside the sealing strip 231, and the graphite material can reduce the sliding resistance between the locking strips 201. As the wall of wedge-shaped through groove 211 has a certain inclination, as shown in FIGS. 7-13, when closing, the locking strip 201 at the rear first contacts graphite 233 part of the locking strip 201 at the front, which reduces the friction and is conducive to the closing movement. Then, the sealing strip 231 performs the first sealing function, and the softer sealing strip 231 first meets the initial sealing conditions. The sealing strip 231 is a long strip with a circular cross section, and its length is consistent with the contact length of two adjacent locking strips 201. As the pressure increases, the outer metal seal 2033 also realizes sealing, wherein the wedge-shaped through groove 211 can be V-shaped or trapezoidal, etc.

Figure 10:
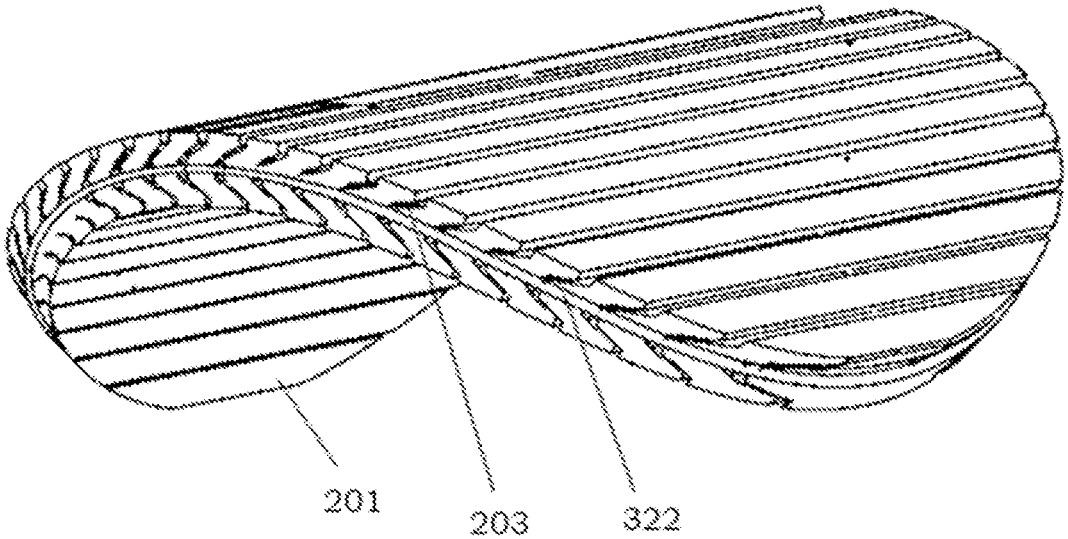
FIG. 10. Three-dimensional view of the valve flap in the natural state.
Figure 11:
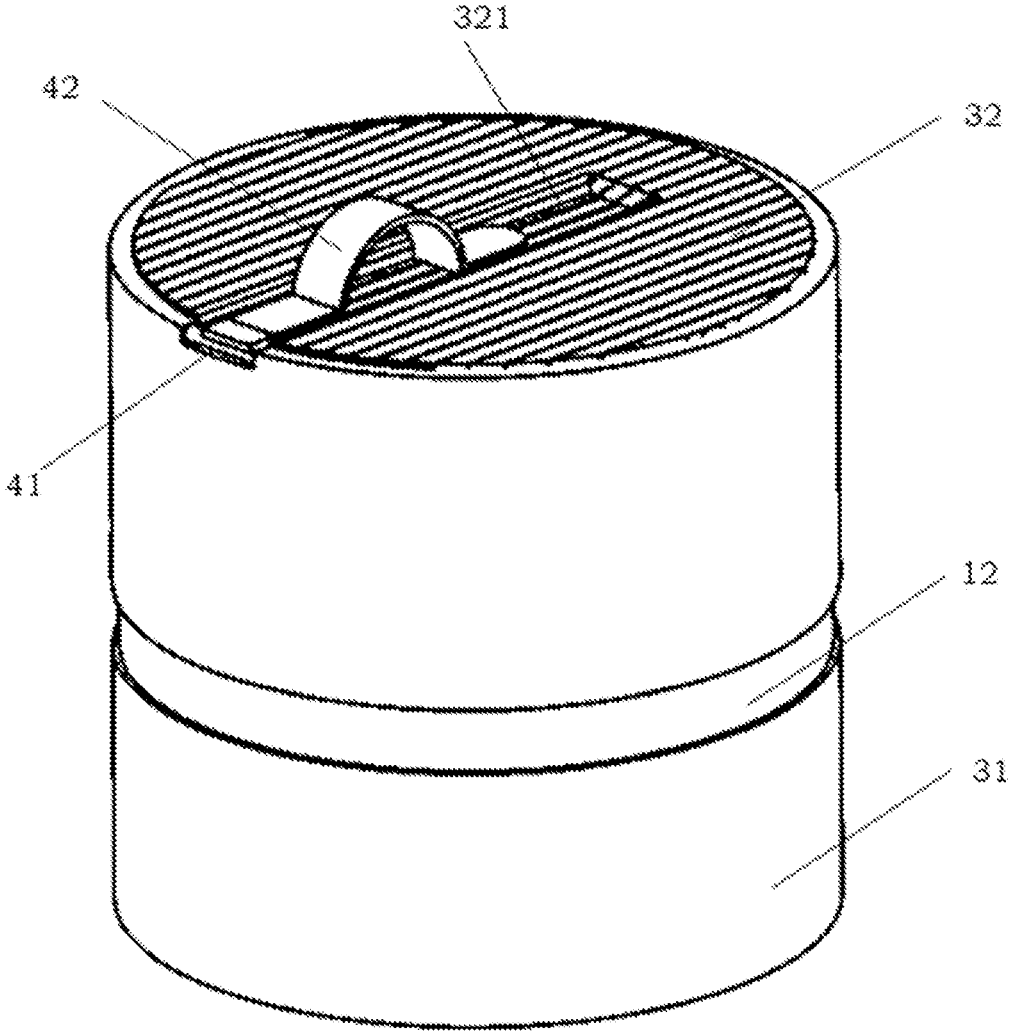
FIG. 11. Three-dimensional view of the chain mail-type flap valve when the valve flap is closed.
Figure 12:
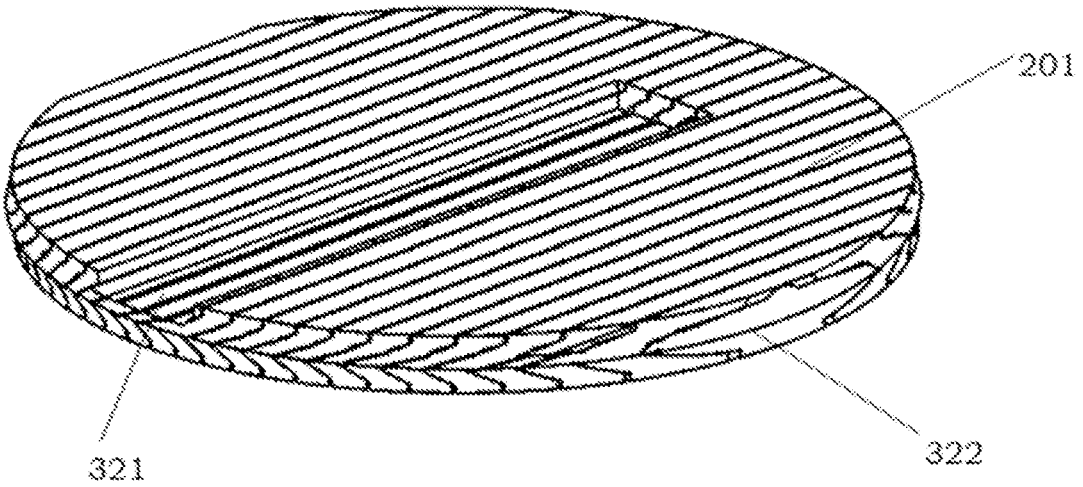
FIG. 12. Three-dimensional view of the valve flap when it is sealed under pressure.
Figure 13:
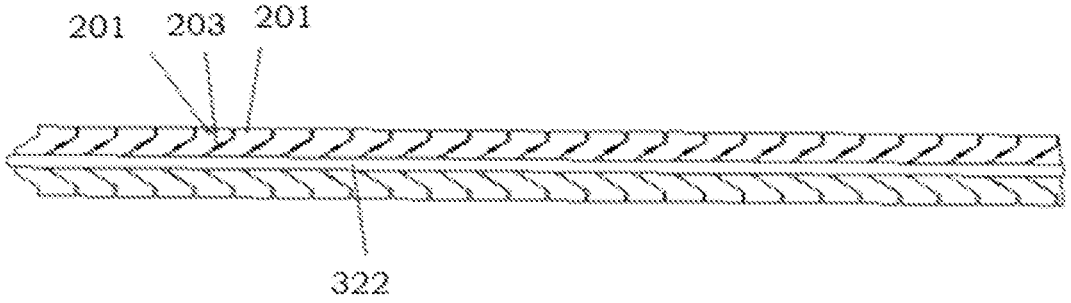
FIG. 13. The front view when the valve flap is sealed under pressure.

When the valve flap 32 contacts the valve port sealing surface 311, the elastic sealing ring 322 is located in the middle of the valve flap 32, the seal 203 is located above the elastic sealing ring 322, and the elastic connecting strip 202 is located above the seal 203. Due to the pressure of the elastic connecting strip 202 and the elastic sealing ring 322, the valve flap 32 tends to become a flat plate structure in the natural state. However, due to the blocking effect of the seal 203, the valve flap 32 is a micro-arc plate structure in the natural state, as shown in FIG. 10. However, when the valve flat 32 is pressurized and in sealing contact with the valve seat 31, as shown in FIGS. 11, 12, and 13, two adjacent locking strips 201 squeeze the sealing element 203 to achieve their sealing contact, and the valve flap 32 is deformed into a circular flat structure. At the same time, the elastic sealing ring 322 realizes the sealing between the valve flat and the valve seat.

As shown in FIGS. 2 and 11, the valve flat 32 is movably connected to the valve seat 31 through a spring sheet 4, which comprises a rotating shaft 41 and an elastic spring sheet 42. The outer side wall of the top end of the valve seat 31 is provided with a rotating shaft holding groove matched with the rotating shaft 41, and the rotating shaft 41 is installed in the rotating shaft holding groove. The outer surface of the valve flap 32 is provided with a spring sheet holding groove 321 containing the spring sheet 42, and the spring sheet 42 is installed in the spring sheet holding groove 321. The spring sheet 42 is a curved steel sheet, which is stuck at the spring sheet holding groove 321. Under the action of external force, the curved steel sheet can be straightened, and its curved surface can be changed into a plane and fully fit with the spring sheet holding groove 321 on the outer surface of valve flat 32.

In another embodiment, the valve flat 32 is hinged with the outer side wall of the upper end of the valve seat 31 by a pin and a torsion spring.

Figure 3:
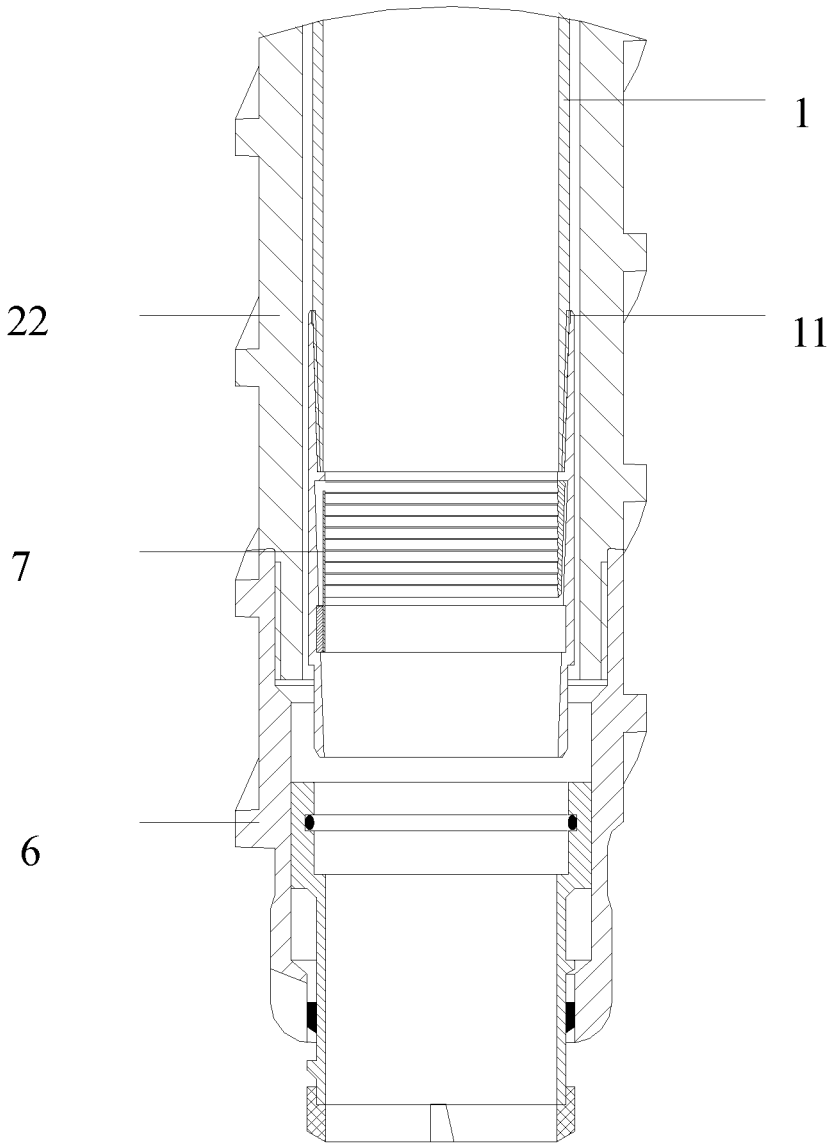
FIG. 3. Enlarged view of B in FIG. 1.

As shown in FIGS. 1 and 3, the inner wall of the lower end of the core barrel 1 is provided with a core catcher 7, the upper part of the core barrel 1 is provided with a piston 8, and the lower end of the drilling machine outer barrel 2 is connected with a drill bit 6, as shown in FIGS. 1 and 2. In the core drilling stage, the lower end of the core barrel 1 passes through the valve seat 31 and extends to the bottom of the drilling machine outer barrel 2, and at this time, the valve flap 32 opens 90°, the triggering inner barrel 52 is in a close contact with the valve flap 32, which can limit the rotation of the valve flap 32. With the drilling of bit 6, the core enters into core barrel 1 from the lower end of core barrel 1 and is grasped by core catcher 7. At this time, the in-situ water environment can invade into core barrel 1.

When the core barrel 1 is lifted up, the core catcher 7 grabs the core and moves upward with the core barrel 1. When the core barrel 1 is lifted to a certain height, the trigger inner barrel 52 loses the restriction effect on the valve flap 32. Under the action of the spring, the valve flap 32 returns to the top surface of the valve seat 31 and is in sealing contact with the valve port sealing surface 311, and thus the valve closes. Finally, the falling trigger inner barrel 52 presses on the valve flap 32 and applies the sealing-specific pressure to the valve flap 32, so as to effectively avoid the liquid loss in core barrel 1.

Of course, there are still many other examples of the present invention. Without departing from the spirit and essence of the present invention, those skilled in the art can make various corresponding changes and deformations according to the invention, but these corresponding changes and deformations shall belong to the protection scope of the claims of the present invention.

The invention claimed is:

1. A core barrel sealing structure comprising a core barrel, a drilling machine outer barrel, a chain mail-type flap valve, and a trigger mechanism; the chain mail-type flap valve includes a valve seat and a chain mail-type valve flap, wherein the valve seat is coaxially installed on the inner wall of the drilling machine outer barrel, one end of the valve flap is movably connected with an outer sidewall of an upper end of the valve seat; the upper end of the valve seat has a valve opening sealing surface adapted to the valve flap; the valve flap includes an elastic sealing ring, elastic connecting strips, sealings, and a plurality of locking strips arranged in parallel; the elastic connecting strip connects all the locking strips in series, and the elastic sealing ring loops all the locking strips together to form an integral structure, and the sealings are located between adjacent locking strips;

the trigger mechanism comprises a trigger inner barrel and a trigger block, and a side wall of the trigger inner barrel is provided with a through hole, the trigger block is arranged in the through hole;

wherein an outer wall of a bottom of the core barrel is provided with a protrusion that matches the trigger block, the inner wall of the drilling machine outer barrel is fitted with a recessed opening adapted to the trigger block, the trigger block is located above the valve flap, and the recessed opening is located above the trigger block;

when the core barrel is located in the valve seat, the trigger inner barrel is located between the core barrel and the drilling machine outer barrel, a lower end of the trigger inner barrel is mated with the valve seat, the trigger block protrudes from the inner sidewall of the trigger inner barrel and the valve flap is opened by 90° and is located between the trigger inner barrel and the drilling machine outer barrel;

when the core barrel is lifted a certain distance above the valve seat, the valve flap returns to a top face of the valve seat to make sealing contact with the valve opening sealing surface, adjacent locking strips are in sealing contact, and a bottom of the trigger inner barrel is pressed against the valve flap.

2. The core barrel sealing structure according to claim 1, characterized in that the trigger mechanism also includes a trigger spring, that is sleeved outside the trigger inner barrel; the outer wall of the trigger inner barrel is provided with a shoulder, the lower end of the trigger spring is pressed against the shoulder, and the upper end of the trigger spring is pressed against the step surface of the drilling machine outer barrel; the trigger spring is located above the trigger block.

3. The core barrel sealing structure according to claim 1, characterized in that the locking strip is provided with a groove adapted to the elastic sealing ring, and the elastic sealing ring is installed in the groove.

4. The core barrel sealing structure according to claim 1, characterized in that when the valve flap is opened 90°, the locking strip is parallel to the axis of the valve seat.

5. The core barrel sealing structure according to claim 1, characterized in that when the valve flap is in sealing contact with the valve seat, the valve flap has a circular flat structure.

6. The core barrel sealing structure according to claim 1, characterized in that except for the two locking strips at the beginning and the end, one side of the other locking strips has a wedge-shaped through groove, and the opposite side has a convex part that fits with the wedge-shaped through groove;

One of the first and last locking strips is provided with a wedge-shaped through groove, while the other locking strip is provided with a convex part;

The convex part of one of the two adjacent locking strips is matched with the wedge-shaped through groove of the other, and the sealing element is arranged between the groove wall and the convex part of the wedge-shaped through groove.

7. The core barrel sealing structure according to claim 6, characterized in that one of the wedge-shaped through grooves has the limit step surface 1 on the groove wall, while the convex portion of the corresponding locking strip has the limit step surface 2 that matches with the limit step surface 1;

When the valve flap is in sealing contact with the valve seat, the limit step surface 1 and the limit step surface 2 are located below the elastic sealing ring, the limit step surface 1 and the limit step surface 2 conflict, and the limit step surface 1 is located on the outside of limit step face 2.

8. The core barrel sealing structure according to claim 7, characterized in that the sealing element is installed on the groove wall of the wedge-shaped through groove.

9. The core barrel sealing structure according to claim 1, characterized in that the valve flap is movably connected to the valve seat through a spring sheet, and the spring sheet includes a rotating shaft and an elastic sheet The outer side wall of the top end of the valve seat has a rotating shaft accommodating groove that matches the rotating shaft, in which the rotating shaft is installed, The outer surface of the valve flap is provided with an elastic sheet accommodating groove for accommodating the elastic sheet, in which the elastic sheet is installed.

10. The core barrel sealing structure according to claim 1, characterized in that a sealing ring is arranged between the outer wall of the valve seat and the inner wall of the drilling machine outer barrel.

* * * * *